United States Patent [19]

Winter et al.

[11] 4,368,113

[45] Jan. 11, 1983

[54] HYDROCARBON HYDROCRACKING PROCESS

[75] Inventors: William E. Winter; Mafer E. Tunison; David W. Staubs, all of Baton Rouge, La.

[73] Assignee: Exxon Research and Engineering Co., Florham Park, N.J.

[21] Appl. No.: 297,721

[22] Filed: Aug. 31, 1981

[51] Int. Cl.[3] ..... C10G 45/02; C10G 69/00

[52] U.S. Cl. ..... 208/89; 208/88

[58] Field of Search ..... 208/88, 89, 97, 106, 208/108, 131, 132

[56] References Cited

U.S. PATENT DOCUMENTS

| | | | |
|---|---|---|---|
| 2,889,263 | 6/1959 | Hemminger et al. | 208/89 X |
| 3,055,823 | 9/1962 | Mason et al. | 208/89 |
| 3,509,044 | 4/1970 | Adams et al. | 208/217 X |
| 3,623,974 | 11/1971 | Mounce et al. | 208/97 |
| 3,730,875 | 5/1973 | Gleim et al. | 208/57 |
| 4,292,168 | 9/1981 | Derbyshire et al. | 208/107 |

*Primary Examiner*—Delbert E. Gantz
*Assistant Examiner*—G. E. Schmitkons
*Attorney, Agent, or Firm*—Marthe L. Gibbons

[57] ABSTRACT

A hydrocracking process is provided in which the heavy bottoms fraction recovered from the hydrocracked product is heat treated prior to being recycled to the hydrocracking zone. The resulting hydrocracked product has an increased amount of constituents boiling in the middle distillate range.

9 Claims, 1 Drawing Figure

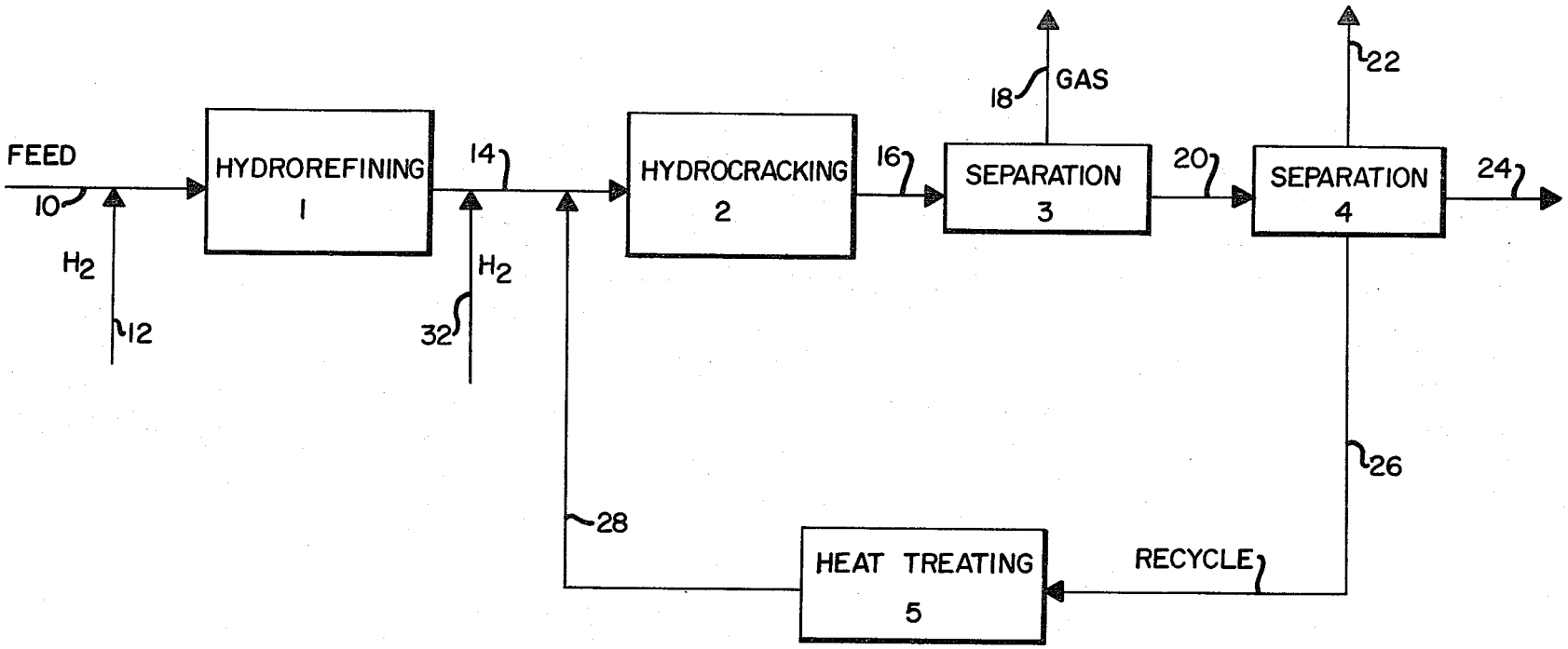
FEED
10
$H_2$
12
HYDROREFINING
1
14
$H_2$
32
HYDROCRACKING
2
16
SEPARATION
3
GAS
18
20
SEPARATION
4
22
24
26
RECYCLE
HEAT TREATING
5
28

HYDROCARBON HYDROCRACKING PROCESS

BACKGROUND OF THE INVENTION

1. Field of the Invention

The present invention relates to an improved hydrocracking process.

2. Description of the Prior Art

Hydrocracking is a well known process for upgrading hydrocarbon fractions. See, for example, *Hydrocarbon Processing,* Sept. 1976, pages 121–128. In the hydrocracking process, a hydrocarbonaceous oil is contacted in the presence of added hydrogen and a hydrocracking catalyst to produce lower boiling hydrocarbons. When the hydrocarbonaceous oil feed for the hydrocracking process comprises a high nitrogen content, the feed is usually hydrorefined in the presence of added hydrogen and a hydrorefining catalyst to decrease the nitrogen content of a feed prior to the hydrocracking stage.

U.S. Pat. No. 3,055,823 discloses a process which comprises hydrorefining a petroleum distillate boiling in the range of 200° to 850° F., preferably, in the range of 325° to 650° F. to denitrify the distillate, removing ammonia from the hydrorefined effluent, heat treating the remaining hydrorefined effluent, and hydrocracking the heat treated effluent. In the heat treating zone, the hydrorefined effluent is passed through a siliceous cracking catalyst at conditions below which significant cracking occurs, i.e. below 650° F.

U.S. Pat. No. 3,730,875 discloses conversion of asphaltene-containing heavy hydrocarbonaceous oils, i.e., more than 10 volume percent boiling above 1050° F., in a combination process comprising catalytic hydrogenation, non-catalytic hydrogenative thermal cracking and catalytic hydrocracking.

It has now been found that subjecting the hydrocracked hydrocarbonaceous bottoms fraction in the absence of hydrogen to a heat treatment and recycling the heat treated bottoms to the hydrocracking zone will increase the selectivity of the hydrocracked products to components boiling in the range of about 300° to about 700° F.

All boiling points to which reference is made herein are atmospheric pressure boiling points unless otherwise specified.

SUMMARY OF THE INVENTION

In accordance with the invention, there is provided, in a hydrocracking process wherein a heavy hydrocarbonaceous feed is contacted with an added hydrogen-containing gas in the presence of a hydrocracking catalyst at hydrocracking conditions in a hydrocracking zone to produce a hydrocracked oil product, separating from said hydrocracked oil product a heavy hydrocarbonaceous bottoms fraction and recycling at least a portion of said heavy hydrocarbonaceous bottoms fraction to said hydrocracking zone, the improvement which comprises: prior to said recycling step, heat-treating said portion of said heavy hydrocarbonaceous bottoms fraction in a heat-treating zone in the absence of added hydrogen and in the absence of a catalyst at conditions below which significant cracking of said portion of bottoms fraction occurs, said conditions including a temperature below about 720° F., for a period of time of at least 0.25 hour.

BRIEF DESCRIPTION OF THE DRAWING

The FIGURE is a schematic flow plan of one embodiment of the invention.

DESCRIPTION OF THE PREFERRED EMBODIMENTS

Referring to the FIGURE, a heavy hydrocarbonaceous oil feed is passed by line 10 into hydrorefining zone 1. A hydrogen-containing gas is introduced into feed line 10 by line 12.

The Heavy Hydrocarbonaceous Oil Feeds

Suitable hydrocarbonaceous feeds passed into hydrorefining zone 1 include heavy hydrocarbonaceous oils boiling above about 650° F. at atmospheric pressure, such as for example, petroleum crude oils; heavy hydrocarbon distillates boiling in the range of about 650° to 1050° F. at atmospheric pressure, such as gas oils. The hydrocarbonaceous oils may be derived from any source such as tar sand oil; shale oil; liquids derived from coal liquefaction processes and mixtures thereof. While raw hydrocarbonaceous feedstocks may be employed in the hydrocracking process, as shown, for example, in U.S. Pat. No. 3,394,074, when the feed has a low nitrogen content or when the hydrocracking catalyst is not sensitive to nitrogen, it is preferable to effect a partial denitrogenation, partial desulfurization and partial saturation of the feed by hydrorefining prior to hydrocracking, as is well known in the art. The feeds subjected to the hydrorefining step generally contain at least about 1000 wppm, preferably at least 200 wppm nitrogen.

The term "hydrorefining" is used herein to designate a catalytic treatment in the presence of hydrogen, of a hydrocarbonaceous oil to upgrade the oil by eliminating or reducing the concentration of contaminants in the oil such as sulfur compounds, nitrogenous compounds, metal contaminants and/or partial saturation of the feed.

Suitable operating conditions in the hydrorefining zone are summarized in the following table.

HYDROREFINING OPERATING CONDITIONS

| Conditions | Broad Range | Preferred Range |
|---|---|---|
| Temperature, °F. | 600–900 | 650–850 |
| Pressure, psig | 600–3500 | 800–3200 |
| Liquid hourly space velocity, V/V/HR | 0.05–5.0 | 0.1–2.5 |
| Hydrogen rate, SCF/BBL | 300–20,000 | 600–12,000 |
| Hydrogen partial pressure, psig | 500–3000 | 800–2500 |

The hydrorefining catalyst present in the hydrorefining zone can be any conventional relatively non-acidic hydrorefining catalyst. Suitable hydrorefining catalysts comprise a hydrogenation component, such as a Group VIB and a Group VIII metal, metal oxide, metal sulfide and mixtures thereof, composited with a carrier, such as cobalt, molybdenum, nickel, tungsten and mixtures thereof on alumina, which may additionally comprise minor amounts of silica, such as the catalysts described, for example, in U.S. Pat. Nos. 3,770,618; 3,509,044 and 4,113,656, the teachings of which are hereby incorporated by reference.

Preferably, the hydrorefining catalyst comprises nickel and molybdenum components composited with an alumina support.

The hydrorefined hydrocarbonaceous product is removed from hydrorefining zone 1 by line 14 and passed into hydrocracking zone 2 operated at hydrocracking conditions. A hydrogen-containing gas is introduced into line 14 by line 32. Any conventional hydrocracking catalyst having cracking activity and hydrogenation activity may be used in the hydrocracking zone, such as, for example, a platinum group metal exchanged aluminosilicate, as shown, for example, in U.S. Pat. No. 3,329,627 or a mixed non-noble metal-containing zeolite, such as shown in U.S. Pat. No. 3,549,518.

Suitable hydrocracking conditions are summarized in the following table.

| HYDROCRACKING CONDITIONS | | |
|---|---|---|
| Conditions | Broad Range | Preferred Range |
| Temperature, °F. | 400–900 | 600–750 |
| Total Pressure, psig | 500–3000 | 1200–1800 |
| Liquid hourly space velocity V/V/HR | 0.1–10 | 0.5–3 |
| Hydrogen rate, SCF/BBL | 300–20,000 | 600–12,000 |

The hydrocracking zone effluent is removed by line 16 and passed to gas-liquid separation zone 3 to separate a normally gaseous product from a normally liquid hydrocarbonaceous product. The gaseous product is removed by line 18. If desired, the gaseous product, which comprises hydrogen, may be recycled to any of the hydroprocessing zones, preferably after conventional removal of undesired constituents, such as $H_2S$, as is well known in the art. The hydrocracked hydrocarbonaceous oil is removed by line 20 and passed to liquid-liquid separation zone 4, such as a fractionation zone, for separation into various fractions, as desired, for example, a light fraction removed by line 22, an intermediate fraction removed by line 24 and a heavy bottoms fraction, which generally includes the 650° F.+ materials. The heavy bottoms fraction is removed by line 26 and at least a portion of it is passed to heat-treating zone 5 which is operated without a catalyst and in the absence of added hydrogen. In heat-treating zone 5, the heavy bottoms fraction is treated under conditions to avoid any significant cracking of constituents, that is, at conditions below thermal cracking conditions. The temperature of the heat treatment can vary widely depending upon the duration of treatment provided the conditions are kept below thermal cracking conditions. Suitable conditions in the heat treating zone include a temperature below about 720° F., preferably from about 500° to about 720° F., more preferably from about 500° to 690° F., most preferably below about 650° F., and a pressure ranging from atmospheric to the pressure of the hydrocracking zone; preferably atmospheric pressure for a time period ranging for at least about 0.25 hour, preferably for a time period ranging from about 0.25 hour to about 7 hours, more preferably, for a time period ranging from about 0.5 hour to about 7 hours. The heat-treated bottoms fraction is removed by line 28 and at least a portion of the heat-treated bottoms portion is passed into line 14 to mix with the hydrorefining zone effluent for recycle into hydrocracking zone 2. The normally liquid hydrocracked products recovered by lines 22 and 24 will have increased selectivity to components boiling in the middle distillate range of about 300° to about 700° F. relative to a similar hydrocracking process performed without heat-treatment of the recycled bottoms fraction.

The following example is presented to illustrate the invention.

EXAMPLE

A light Arabian vacuum gas oil boiling from about 650° to 1050° F. and having the properties listed in Table I was used for a simulated liquid recycle hydrocracking experiment. The liquid recycle was simulated in the sense that batch, instead of continuous, distillation was used to separate the unconverted bottoms for recycle.

TABLE I

| FEED PROPERTIES | |
|---|---|
| Gravity, °API at 60° F. | 21.3 |
| Sulfur, Wt. % | 2.28 |
| Nitrogen, wppm | 900 |
| Aniline point, °F. | 189 |
| ASTM Distillation | |
| 5% | 719 |
| 50% | 876 |
| 95% | 1016 |
| Aromatics, Wt. % | 51.8 |
| Naphthenes, Wt. % | 29.1 |
| Paraffines, Wt. % | 13.6 |

The experiment was carried out in a pilot plant equipped with a hydrorefining reactor (R-1) and a hydrocracking reactor (R-2), with recycle of unconverted bottoms to R-2. Feed was introduced continuously to R-1. R-1 total effluent was combined with unconverted bottoms (650° F.+) from R-2 and then introduced to R-2. Liquid product from R-2 was collected over a material balance period and then fractionated in batch distillation equipment to recover the unconverted bottoms, a portion of which was subsequently used in combination with R-1 effluent as feed to R-2.

R-1 contained a conventional NiMo on alumina hydrorefining catalyst, and operated at about 760° F. and 0.66 LHSV and at a hydrogen partial pressure of about 1300 psia. R-2 contained a conventional NiMo on Y zeolite and alumina hydrocracking catalyst, and operated at about 720° F. and 4.19 LHSV and at the same hydrogen partial pressure as R-1. The volume ratio of recycle feed to fresh feed was 0.73.

This process, designated Process A, is in accordance with prior art hydrocracking processes. The above described process, herein designated Process A, is a comparative process and is not a process in accordance with the present invention.

The same process, except with the addition of the heat-treating step of the present invention, was performed on the same feed and at the same hydrorefining and hydrocracking conditions and utilizing the same catalysts. This process is designated herein Process B. The heat-treating step was carried out by subjecting the unconverted bottoms that were fed to R-2 and that had been previously recovered by batch distillation to temperatures less than 700° F., for a period of time between 10 and 16 hours. The time and temperature of the heat-treatment step were such that there was no significant conversion of the bottoms, as shown by a still balance for that batch distillation of close to 100%.

The results of these experiments are summarized in Table II.

TABLE II

| | Process A | Process B |
|---|---|---|
| CONDITIONS | | |
| R-1 Temperature, °F. | 757 | 757 |
| R-1 LHSV(1) | 0.66 | 0.65 |
| R-2 Temperature, °F. | 719 | 723 |
| R-2 LHSV(1) | 4.19 | 4.09 |
| $H_2$ Pressure, psia | 1290 | 1270 |
| Treat Gas, SCF/B | 4790 | 4960 |
| RESULTS | | |
| 650° F. Conversion, Vol. % on fresh feed | 54.9 | 58.0 |
| 320–650° F. Yield, Vol. % on fresh feed | 29.9 | 36.3 |
| 320–650° F. Gravity, °API at 60° F. | 38.0 | 38.7 |
| Aniline Point, °F. | 137.5 | 139 |

(1)LHSV = liquid hourly space velocity, volumes of oil per volume of catalyst per hour.

As can be seen from Table II, Process B, which is a process in accordance with the present invention, produced a greater yield of 320°–650° F. middle distillate with no loss in quality, as indicated by gravity and aniline point.

What is claimed is:

1. In a hydrocracking process wherein a heavy hydrocarbonaceous feed is contacted with an added hydrogen-containing gas in the presence of a hydrocracking catalyst at hydrocracking conditions in a hydrocracking zone to produce a hydrocracked oil product, separating from said hydrocracked oil product a heavy hydrocarbonaceous bottoms fraction and recycling at least a portion of said heavy hydrocarbonaceous bottoms fraction to said hydrocracking zone, the improvement which comprises: prior to said recycling step, heat-treating said portion of said heavy hydrocarbonaceous bottoms fraction in a heat-treating zone in the absence of added hydrogen and in the absence of a catalyst at conditions below which significant cracking of said portion of bottoms fraction occurs, said conditions including a temperature in the range of about 500° to about 720° F., for a period of time of at least 0.25 hour.

2. The process of claim 1 wherein said heavy hydrocarbonaceous feed to said hydrocracking zone has an atmospheric pressure boiling point of at least 650° F.

3. The process of claim 1 wherein said heavy feed to said hydrocracking zone has an atmospheric pressure boiling point ranging from 650° to 1050° F.

4. The process of claim 1 wherein said heat treating is conducted for a period of time ranging from about 0.25 hour to about 7 hours.

5. The process of claim 1 wherein said heat treating is conducted for a period of time ranging from about 0.5 hour to about 7 hours.

6. The process of claim 1 wherein said heat-treating conditions include a temperature ranging from about 500° to about 690° F.

7. The process of claim 1 wherein said hydrocracking conditions include a temperature ranging from about 400° to about 900° F. and a pressure ranging from about 500 to about 3500 psig.

8. The process of claim 1 wherein prior to said hydrocracking step, said heavy hydrocarbonaceous feed is hydrorefined in the presence of added hydrogen and a hydrorefining catalyst to produce a hydrorefined heavy hydrocarbonaceous feed.

9. The process of claim 8 wherein said hydrorefining conditions include a temperature ranging from about 600° to about 900° F. and a pressure ranging from about 50 to about 3500 psig.

* * * * *